US010788043B2

(12) United States Patent
He et al.

(10) Patent No.: US 10,788,043 B2
(45) Date of Patent: Sep. 29, 2020

(54) BLOWER FAN

(71) Applicant: JIANGMEN KEYE ELECTRIC APPLIANCES MANUFACTURING CO., LTD, Jiangmen, Guangdong Province (CN)

(72) Inventors: Xiangming He, Jiangmen (CN); Guanglian Lin, Jiangmen (CN)

(73) Assignee: JIANGMEN KEYE ELECTRIC APPLIANCES MANUFACTURING CO., LTD, Jiangmen (CN)

( * ) Notice: Subject to any disclaimer, the term of this patent is extended or adjusted under 35 U.S.C. 154(b) by 196 days.

(21) Appl. No.: 15/797,866

(22) Filed: Oct. 30, 2017

(65) Prior Publication Data

US 2019/0128281 A1 May 2, 2019

(51) Int. Cl.
*F04D 25/06* (2006.01)
*F04D 17/16* (2006.01)
(Continued)

(52) U.S. Cl.
CPC ..... *F04D 25/068* (2013.01); *F04D 17/16* (2013.01); *F04D 29/005* (2013.01); *F04D 29/601* (2013.01)

(58) Field of Classification Search
CPC ..... F04D 17/16; F04D 25/068; F04D 29/005; F04D 29/462; F04D 29/601
See application file for complete search history.

(56) References Cited

U.S. PATENT DOCUMENTS

D152,778 S 2/1949 Fox
4,377,107 A * 3/1983 Izumi ..... B60H 1/3428 454/155
(Continued)

FOREIGN PATENT DOCUMENTS

| | | | |
|---|---|---|---|
| CN | 2811632 | Y | 8/2006 |
| CN | 105020159 | A | 11/2015 |
| CN | 106225461 | A | 12/2016 |

OTHER PUBLICATIONS

8-Air VP-25 1 /4 HP 900 CFM Air Mover for Water Damage Restoration Equipment Carpet Dryer Floor Blower Fan Home and Plumbing Use, date first available Mar. 25, 2016, site visited Jun. 29, 2019.

(Continued)

*Primary Examiner* — Patrick Hamo
*Assistant Examiner* — Joseph S. Herrmann
(74) *Attorney, Agent, or Firm* — Innovation Capital Law Group, LLP; Vic Lin

(57) ABSTRACT

The present invention relates to a blower fan, comprising two side walls, an air duct, a handle, a motor, a wind wheel and a motor control assembly; the two side walls are arranged in parallel with each other; the air duct is arranged between the two side walls in a rotatable way; the handle is mounted on the air duct; the motor and the wind wheel are both mounted in the air duct; the motor control assembly is arranged on a side wall close to the motor and is electrically connected with the motor, installation position of the motor control assembly with respect to the side wall being at an inner side of the side wall. According to the present invention, the air blowing angle is adjustable due to the rotation of the air duct, achieving a better drying effect. Additionally, the structure of the present invention is compact, attractive in appearance and durable.

8 Claims, 6 Drawing Sheets

(51) Int. Cl.
*F04D 29/00* (2006.01)
*F04D 29/60* (2006.01)

(56) References Cited

U.S. PATENT DOCUMENTS

| | | | | |
|---|---|---|---|---|
| D269,116 | S * | 5/1983 | Armbruster | D23/328 |
| 4,424,006 | A * | 1/1984 | Armbruster | F21V 33/0088 417/234 |
| 4,483,664 | A * | 11/1984 | Armbruster | F21V 33/0088 417/234 |
| 5,048,202 | A * | 9/1991 | Shero | F26B 21/001 34/618 |
| 5,174,048 | A | 12/1992 | Shero | |
| D340,326 | S | 10/1993 | Genovese | |
| 5,265,895 | A | 11/1993 | Barrett | |
| 5,555,643 | A | 9/1996 | Guasch | |
| D482,772 | S | 11/2003 | Dooley | |
| 6,821,095 | B2 * | 11/2004 | Dooley | F04D 25/08 415/126 |
| D512,500 | S | 12/2005 | Wilson, Jr. | |
| D512,501 | S | 12/2005 | Wilson, Jr. | |
| D517,677 | S | 3/2006 | Bartholmey | |
| D530,002 | S | 10/2006 | Ching | |
| D566,823 | S | 4/2008 | Lewis | |
| D594,962 | S | 6/2009 | Lewis | |
| D596,283 | S | 7/2009 | Martinez et al. | |
| 7,699,580 | B2 * | 4/2010 | Lasko | F24H 3/0417 415/102 |
| 8,235,686 | B2 * | 8/2012 | Wark | F04D 25/084 416/147 |
| D687,137 | S | 7/2013 | Nemes | |
| D698,433 | S | 1/2014 | Tomasiak et al. | |
| D704,908 | S | 5/2014 | Cui | |
| D810,269 | S | 2/2018 | Sanders et al. | |
| D836,766 | S | 12/2018 | He et al. | |
| D837,360 | S | 1/2019 | Cui | |
| D849,924 | S | 5/2019 | Sanders et al. | |
| 2004/0047743 | A1 | 3/2004 | Dooley et al. | |
| 2006/0049615 | A1 | 3/2006 | Day | |
| 2009/0238687 | A1 * | 9/2009 | Lin | F04D 25/06 415/214.1 |
| 2016/0175472 | A1 | 6/2016 | Tan | |
| 2017/0051748 | A1 | 2/2017 | He et al. | |
| 2019/0128281 | A1 | 5/2019 | He et al. | |

OTHER PUBLICATIONS

Stanley 655704 High Velocity Blower Fan, date posted unknown, site visited Jun. 29, 2019, Available from Internet.

* cited by examiner

BLOWER FAN

FIELD OF TECHNOLOGY

The present invention relates to the technical field of blower fan and, more particularly, to a blower fan with adjustable air blowing angle.

BACKGROUND

A blower fan is a machine which sucks air into the machine from the outside through an air inlet and then blows it out from an air outlet. A blower fan generally has a volute-shaped body, with an air outlet close to the ground; the body is provided with foot-pads and therefore the machine can be placed on the ground to dry a wet place. A traditional blower fan has a body formed integrally and the angle of its air outlet is fixed; however, in use, the air blowing angle often needs to be adjusted to achieve a better drying effect.

A traditional blower fan with an adjustable air blowing angle comprises two side walls, an air duct, a handle and a motor, wherein the air duct is arranged between two side walls in a rotatable way; however, the handle is mounted on the two side walls, which will hinder the rotating of the air duct; in order to ensure the rotation of the air duct, it is necessary to increase the size of the blower fan, thus increasing the transport and storage costs. In addition, since the weight of the blower fan is mainly caused by the air duct and the handle is mounted on the side walls, when the blower fan is lifted up, the joints between the side walls and the air duct are likely to be damaged due to an excessive stress.

SUMMARY

Therefore, the present invention is intended to provide a blower fan which has an adjustable air blowing angle to achieve a better drying effect and in addition is compact in structure, attractive in appearance and durable.

The object of the present invention is achieved by the following technical solution: a blower fan comprising two side walls, an air duct, a handle, a motor, a wind wheel and a motor control assembly; the two side walls are arranged in parallel with each other; the air duct is arranged between the two side walls in a rotatable way; the handle is mounted on the air duct; the motor and the wind wheel are both mounted in the air duct; the motor control assembly is arranged on a side wall close to the motor, and the installation position of the motor control assembly with respect to the side wall is at an inner side of the side wall; and the motor control assembly is electrically connected with the motor.

Further, the side wall on which the motor control assembly is arranged is provided with a hollow portion, and the motor control assembly runs through the hollow portion and then protrudes from an outer side of the side wall.

Further, the two side walls are each composed of a support frame and a fixing frame, and the fixing frame is located above the support frame.

Further, the air duct is of a hollow volute shape, and at least one side of the air duct is provided with an air inlet, and an air outlet is arranged at the front end of the air duct; and the motor is fixed to an inner side wall of the air inlet of the air duct.

Further, at least one of the two side walls is provided with a plurality of detents, and the air duct is provided with a positioning mechanism corresponding to the detents.

Further, the plurality of detents are arranged at equal intervals to make a circle.

Further, the plurality of detents are arranged at an interval of between 5 and 20 degrees.

Further, the wind wheel comprises at least one set of fan blades.

Further, the motor control assembly comprises a control switch, an auxiliary power outlet and a circuit protection device, the control switch is electrically connected to the motor, and the circuit protection device is electrically connected to the auxiliary power outlet.

Further, the blower fan further comprises a bottom base, and the bottom base is connected to the two side walls.

Compared with the prior art, the present invention has the following advantages: firstly, the air duct can rotate in a direction perpendicular to the side walls so as to realize the adjustable air blowing angle to meet the demand of the user for different air blowing angles and achieve a better drying effect; secondly, the motor control assembly runs through one of the side walls, connected from the inner side of the side wall and protruding from the outer side of the side wall, and thus the motor control assembly is convenient to mount and detach and does not affect the aesthetics; thirdly, Since the handle is arranged on the air duct, the rotation of the air duct is not limited by the distance between the handle and the air duct, thus ensuring more compact overall structure of the blower fan; additionally, since the weight of the blower fan is mostly caused by the air duct and the motor and the motor of the present invention is installed in the air duct, the handle is arranged on the air duct so that the joints between the side walls and the air duct can be prevented from being damaged by an excessive stress.

For better understanding and implementation, a detailed description of the invention is given with accompanying drawings as follows.

DETAILED DESCRIPTION

Figure 1:
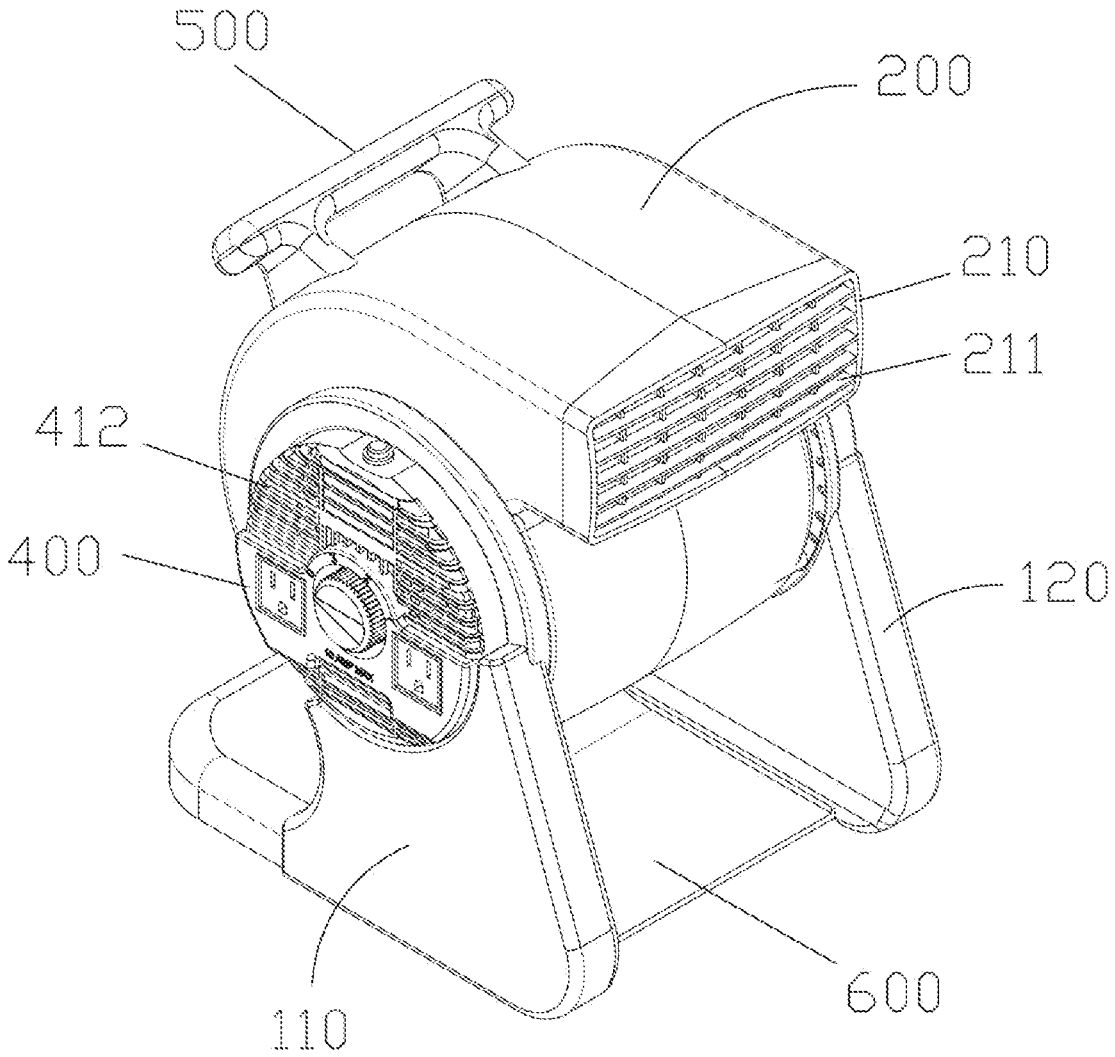
FIG. 1 is a left side perspective view of a blower fan according to an embodiment.
Figure 2:
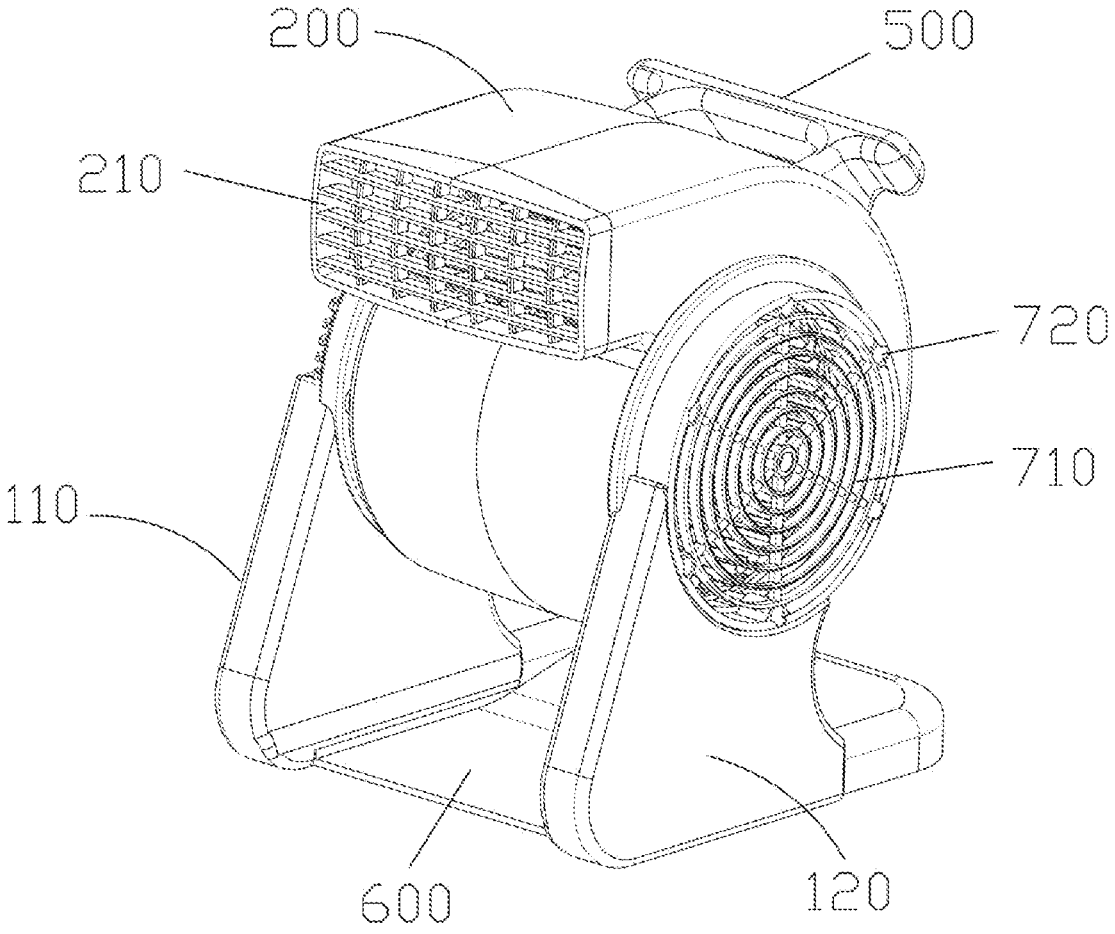
FIG. 2 is a right side perspective view of the blower fan according to the embodiment.
Figure 3:
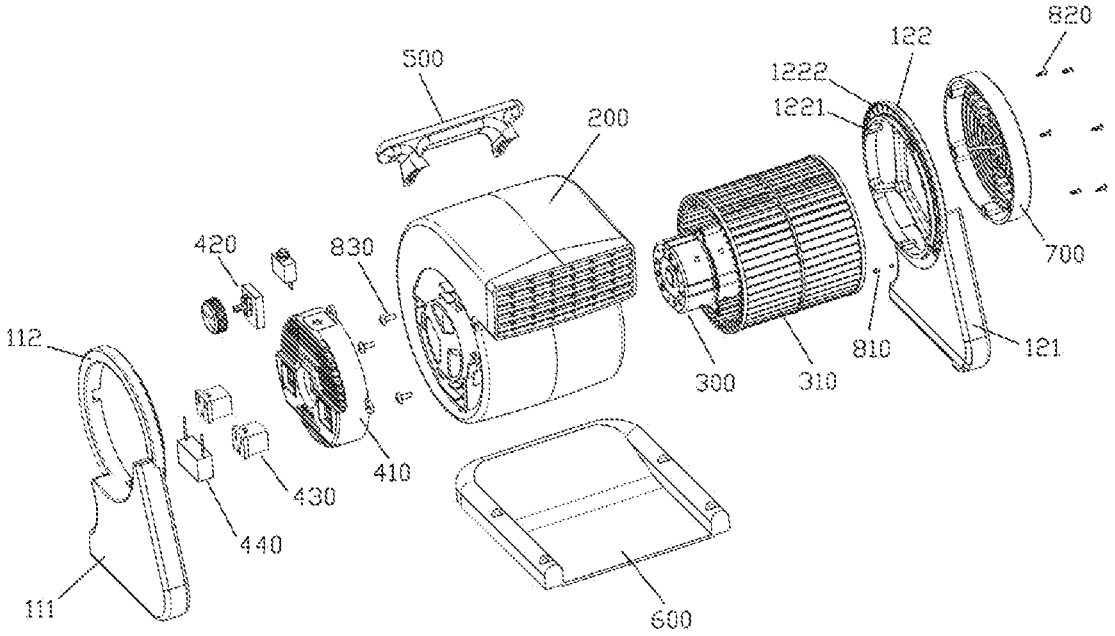
FIG. 3 is an exploded perspective view of the blower fan according to the embodiment.
Figure 4:
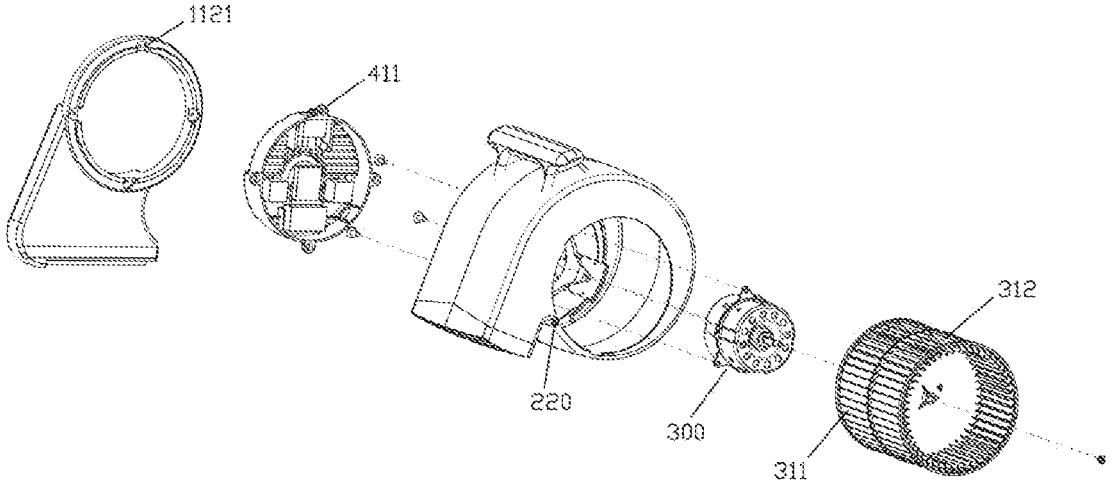
FIG. 4 is an exploded perspective view of a partial structure in another aspect of the blower fan according to the embodiment.

The present invention will be described below in further detail with reference to the accompanying drawings. In the description of the present invention, it is to be understood that the orientations or positional relationships, indicated by the terms "center", "longitudinal", "lateral", "upper", "lower", "front", "rear", "left", "right", "vertical", "horizontal", "top", "bottom", "inside", "outside" and the like, are based on the orientations or positional relationships shown in the drawings and are only for the purpose of facilitating and simplifying the description of the present invention, rather than indicating or implying that the described device or element must have a particular orientation or must be constructed and operated in a particular orientation, and therefore they cannot to be construed as limiting the present invention. In the description of the present invention, the meaning of "a plurality of" is two or more, unless otherwise specified.

FIGS. 1, 2, 3, and 4 which respectively are the left side perspective view, the right side perspective view, the exploded perspective view, and the exploded perspective view of a partial structure in another aspect of the blower fan of this embodiment are further referred to. The blower fan according to this embodiment comprises a first side wall 110, a second side wall 120, an air duct 200, a motor 300, a motor control assembly 400, a handle 500, and a bottom base 600.

The first side wall 110 and the second side wall 120 are arranged in parallel with each other. Specifically, the first side wall 110 consists of a lower first support frame 111 and a upper first fixing frame 112, and in this embodiment, the first fixing frame 112 is of an annular shape, with a plurality of clamping slots 1121 along its circumferential direction. The second side wall 120 consists of a lower second support frame 121 and a upper second fixing frame 122. In this embodiment, the second fixing frame 112 is of an annular shape, with a plurality of clamping grooves 1221 uniformly arranged at the inner side in its circumferential direction and a plurality of detents 1222 uniformly arranged at the outer side in its circumferential direction, and the interval radian of the plurality of detents 1222 is preferably 10 degrees.

The air duct 200 is disposed between the first side wall 110 and the second side wall 120 in a rotatable way and the direction of its rotation axis is perpendicular to the first side wall 110 and the second side wall 120. In this embodiment, the air duct 200 is of a hollow volute shape. An air outlet 210 is arranged at the front end of the air duct 200. Specifically, the air outlet 210 is rectangular and is provided with a grille 211 for assisting the control of air at the outlet and for preventing the external object from entering the air duct. The grille 211 may be fixedly mounted at the air outlet 210 or may be adjusted in a horizontal or vertical direction so that air at the outlet can be changed in accordance with the use demand.

Figure 5:
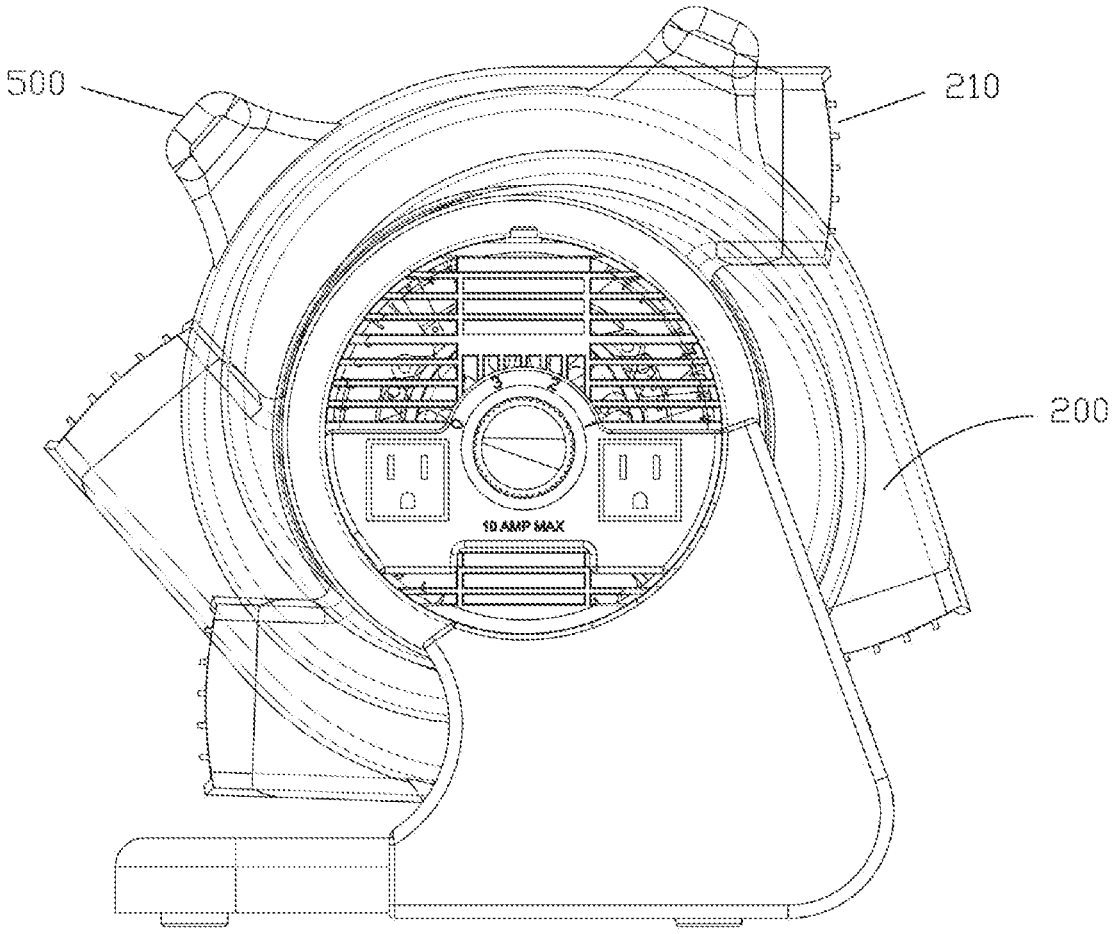
FIG. 5 is a schematic diagram showing the change of the air blowing angle of an air duct of the blower fan according to the embodiment.

The side faces of the air duct 200 are arranged in parallel with the first side wall 110 and the second side wall 120, and the air duct 200 is detachably connected to the second side wall 120. Specifically, a positioning groove 220 is formed at the periphery of the side face, in the vicinity of the second side wall 120, of the air duct 200, and the positioning groove 220 correspond to the plurality of detents 1222 on the second side wall 120. One of the detents 1222 can be connected to the positioning groove 220 by a fastener 810 so as to stabilize the position of the air duct 200. When the position of the air duct 200 needs to be changed, the air duct 200 is rotated to a desired position along the rotation axis, and at this moment, the positioning groove 220 corresponds to another detent 1222, and then the another detent 1222 is connected with the positioning groove 220 through the fastener 810 to stabilize the air duct 200. With reference to FIG. 5 which is a schematic diagram showing the change of the air blowing angle of the air duct of the blower fan according to the embodiment, the air duct 200 is rotatable through about 240 degrees.

The side face, in the vicinity of the second side wall 120, of the air duct 200 is also connected to an air intake component 700. The air intake component 700 is a circular housing with a second inlet 710 in the surface, the second inlet 710 is provided with a protective net which is used for preventing the external object from entering the air duct. The outer circumference of the circular housing is uniformly provided with mounting grooves 720 which correspond to the clamping grooves 1221 in the second side wall 120. The air intake component 700 is connected to the second side wall 120 through a fastener 820. In this embodiment, the fastener 820 is a screw.

The handle 500 is arranged on the air duct 200 and rotates together with the air duct 200. The blower fan can be lifted up and moved more conveniently due to arrangement of the handle 500. The handle 500 is arranged on the air duct 200 so that the handle 500 can rotate together with the air duct 200; therefore, the rotation of the air duct 200 is not limited by the distance between the handle 500 and the air duct 200, and the distance between the handle 500 and the air duct 200 just need to ensure that the hand of a user can pass, so that the overall structure can be more compact, thus saving the space. In addition, since the weight of the blower fan is mainly caused by the air duct 200, the handle 500 is arranged on the air duct 200 so that the joints between the side walls and the air duct are prevented from being damaged due to an excessive stress.

The bottom base 600 is located below the air duct 200 and the two sides of the bottom base 600 are respectively connected to the first support frame 111 at the bottom of the first side wall 110 and the second support frame 121 at the bottom of the second side wall 120. The distance between the bottom base 600 and the air duct 200 can ensure that the air duct 200 will not come into contact with the bottom base 600 when the air duct 200 is rotated.

The motor 300 is installed in the air duct 200. Specifically, the motor 300 is fixed to the inner side wall of the air duct 200 by a fastener 830, and rotates together with the air duct 200. The motor 300 is connected to a wind wheel 310 which comprises a first set of blade 311 and a second set of blade 312, being close to the first side wall 110 and the second side wall 120, respectively.

The motor control assembly 400 is arranged on the first side wall 110 and is electrically connected to the motor 300. In particular, the motor control assembly 400 comprises a control panel 410 having a semi-encircled shape to form an interior space into which a portion of the motor 300 is supported. In this embodiment, the outer periphery of the control panel 410 is circular and the edge thereof is uniformly provided with a plurality of protrusions 411. The protrusions 411 are matched with the clamping slots 1121 of the first fixing frame 112 of the first side wall 110, and thus the control panel 410 is fixed to the inside of the first fixing frame 112 and protrudes from the outside of the first fixing frame 112. In addition, the control panel 410 is further provided with a first air inlet 412 which is shaped like a long strip.

Figure 6:
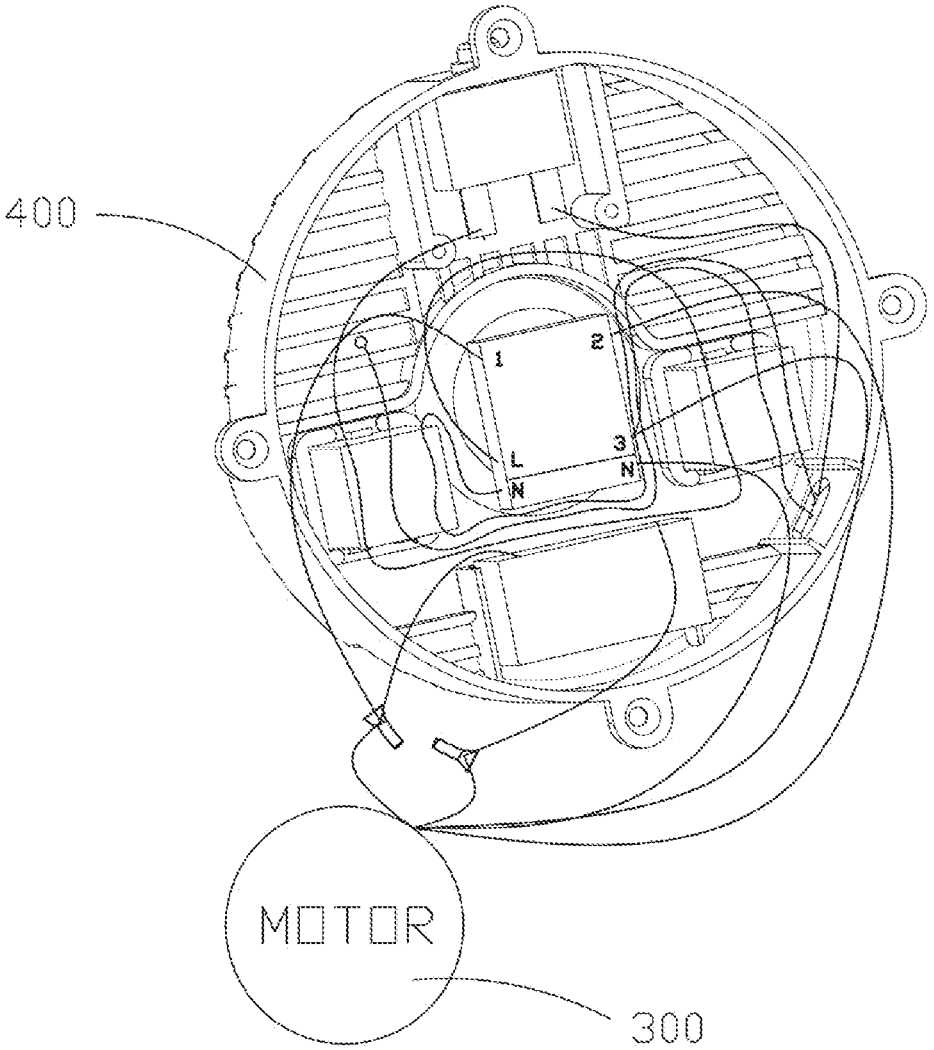
FIG. 6 is a schematic diagram showing the internal structure of a control component of the blower fan according to the embodiment.

The motor control assembly 400 further comprises a control switch 420, an auxiliary power outlet 430, and a circuit protection device 440 mounted on the control panel 410. With reference to FIG. 6, which is a schematic diagram showing the internal structure of the motor control assembly 400 of the blower fan according to the embodiment. In this embodiment, the control switch 420 is a multi-position rotary switch, and is electrically connected to the motor 300 to control its operation. The circuit protection device 440 is a circuit breaker and is electrically connected to the auxiliary power outlet 430. The circuit protection device 440 is used to cut off a power source to protect a circuit when the circuit has a failure.

In the present embodiment, a portion of outside air enters the wind wheel 310 through the first air inlet 412 and gets close to the first set of blade 311; another portion of outside air enters the wind turbine 310 through the second air inlet 710 and gets close to the second set of blade 312. The motor 300 drives the wind wheel 310 to rotate, and the air generated by the first set of blade 311 and the second set of blade 312 is discharged through the air outlet 210.

Compared with the prior art, the present invention has the following advantages: firstly, the air duct can rotate in a direction perpendicular to the side walls so as to realize the adjustable air blowing angle to meet the demand of the user for different air blowing angles and achieve a better drying effect; secondly, the motor control assembly runs through one of the side walls, connected from the inner side of the side wall and protruding from the outer side of the side wall, and thus the motor control assembly is convenient to mount and detach and does not affect the aesthetics; thirdly, Since the handle is arranged on the air duct, the rotation of the air duct is not limited by the distance between the handle and the air duct, thus ensuring more compact overall structure of the blower fan; additionally, since the weight of the blower fan is mostly caused by the air duct and the motor and the motor of the present invention is installed in the air duct, the handle is arranged on the air duct so that the joints between the side walls and the air duct can be prevented from being damaged by an excessive stress.

The above-described embodiment shows only one embodiment of the present invention, which is more specific and detailed, but is not to be construed as limiting the scope of the invention. It should be noted that various variants and improvements can be made by those skilled in the art without departing from the spirit of the invention and all these variants and improvements fall within the scope of the present invention.

What is claimed is:

1. A blower fan comprising:

two side walls which are arranged in parallel with each other, each side wall being composed of a support frame and a fixing frame located above the support frame;

an air duct which is arranged between the two side walls in a rotatable way, the air duct being of a hollow volute shape, two sides of the air duct connecting to the fixing frames of the two side walls respectively, and at least one side of the air duct being provided with an air inlet, an air outlet being arranged at a front end of the air duct;

a handle mounted on the air duct and fixed on an outer wall of the air duct;

a motor mounted in the air duct and fixed to an inner side wall of the air duct by a fastener, such that the motor rotates together with the air duct relative to the two side walls;

a wind wheel located in the air duct, connected to the motor, and driven by the motor; and a motor control assembly which is arranged on a side wall close to the motor and is electrically connected with the motor, an installation position of the motor control assembly with respect to the side wall close to the motor being at an inner side of the side wall.

2. The blower fan according to claim 1, characterized in that the side wall on which the motor control assembly is arranged is provided with a hollow portion, through which the motor control assembly passes and then protrudes from an outer side of the side wall.

3. The blower fan according to claim 1, characterized in that at least one of the two side walls is provided with a plurality of detents, and the air duct is provided with a positioning mechanism corresponding to the detents.

4. The blower fan according to claim 3, characterized in that the plurality of detents are arranged at equal intervals to make a circle.

5. The blower fan according to claim 4, characterized in that the interval of the plurality of detents is between 5 and 20 degrees.

6. The blower fan according to claim 1, characterized in that the wind wheel comprises at least one set of fan blades.

7. The blower fan according to claim 1, characterized in that the motor control assembly comprises a control switch, an auxiliary power outlet and a circuit protection device, wherein the control switch is electrically connected to the motor, and the circuit protection device is electrically connected to the auxiliary power outlet.

8. The blower fan according to claim 1, characterized in that the blower fan further comprises a bottom base, which is connected to the two side walls.

* * * * *